United States Patent [19]

Wang

[11] Patent Number: 4,790,112

[45] Date of Patent: Dec. 13, 1988

[54] ASSEMBLY OF TWO INTERCONNECTED SIMILAR PLASTIC PLANKS AND A FRAMEWORK

[76] Inventor: Cheh Wang, 4th Fl., No. 8, Alley 2, Lane 81, Yung Li Rd., Yung-Ho City, Taipei Hsein, Taiwan

[21] Appl. No.: 74,869

[22] Filed: Jul. 17, 1987

[51] Int. Cl.[4] ..... E04C 1/36; E04D 1/36

[52] U.S. Cl. ..... 52/460; 52/465; 52/546; 52/586; 52/588

[58] Field of Search ..... 52/546–548, 52/519–522, 459–462, 465, 469, 471, 543, 586, 588

[56] References Cited

U.S. PATENT DOCUMENTS

| | | | |
|---|---|---|---|
| 3,650,080 | 3/1972 | Leale | 52/469 |
| 4,373,315 | 2/1983 | Farrant | 52/522 |
| 4,441,291 | 4/1984 | Sokoler et al. | 52/588 |

FOREIGN PATENT DOCUMENTS

| | | | |
|---|---|---|---|
| 2049008 | 12/1980 | United Kingdom | 52/588 |

*Primary Examiner*—James L. Ridgill, Jr.
*Attorney, Agent, or Firm*—Nixon & Vanderhye

[57] ABSTRACT

An improved assembly includes a framwork, two interconnected similar plastic planks, and a fastener for attaching the planks to the framework. The improvement wherein each of the planks includes an L-shaped outwardly projecting plate and a first abutment portion on a side thereof, and a U-shaped projecting plate and a second abutment portion on the opposite side thereof. The L-shaped projecting plate can be held within and on the U-shaped projecting plate to provide a waterproof effect when the planks are interconnected side by side. A U-shaped cover is sleeved on the U-shaped projecting plate so as to provide an additional waterproof effect.

17 Claims, 6 Drawing Sheets

ASSEMBLY OF TWO INTERCONNECTED SIMILAR PLASTIC PLANKS AND A FRAMEWORK

BACKGROUND OF THE INVENTION

The present invention relates to an assembly of two interconnected similar plastic planks and a framework, and more particularly to one in which the planks are firmly interconnected.

In recent years, instead of a tile roof, a series of interconnected similar plastic planks have been positioned and fastened onto rafters running from the peak of the roof to its eaves in a side by side manner so as to form a sheathing. Referring to FIG. 1, there are shown two interconnected conventional planks A' and B'. Each of the conventional planks A' and B' has a U-shaped side portion 1 and an inverted U-shaped side portion 2. Each of the U-shaped side portion 1 and the inverted U-shaped side portion 2 has an inwardly inclined end edge 11, 21 so that the inverted U-shaped side portion 2 of the plank A' is held on the U-shaped side portion 1 of the plank B'. When the planks are interconnected, a seal strip 3 is used to seal the U-shaped side portion 1 so as to provide a water-proof effect. In absence of the seal strip 3, such a assembly is not water-proof. In additon, it is easy for the two interconnected side portions 1 and 2 to loosen from each other. Furthermore, after the seal strip 3 is provided between the two interconnected planks A' and B', the assembly becomes unsightly.

SUMMARY OF THE INVENTION

It is an object of the present invention to provide an improved assembly of two interconnected similar plastic planks and a framework, in which the planks can be firmly interconnected before they are fastened onto the framework.

It is another object of the present invention to provide an assembly of two interconnected similar platic planks and a framework, which can be water-proof without the sealing of a seal strip.

According to the present invention, the improved assembly is of the type having two interconnected similar plastic planks, a framework, and a fastening means for attaching the planks to the framework, the planks including a first plank and a second plank, characterized in that each of the planks includes a first side including an L-shaped projecting plate and a first abutment portion thereon, a second side positioned opposite to the first side and including a U-shaped projecting plate and a second abutment portion thereon, and means for holding the L-shaped projecting plate of the first plank within and on the U-shaped projecting plate of the second plank when the first abutment portion of the first plank abuts against the second abutment portion of the second plank.

Each of the L-shaped projecting plates includes a vertical plate extending longitudinally upwardly from the upper surface of the plank, and a horizontal plate extending horizontally outwardly from the end of the vertical plate.

Each of the U-shaped projecting plates includes a long vertical plate extending longitudinally upwardly from the upper surface of the plank and being of a width slightly greater than that of the vertical plate of the L-shaped projecting plate, a horizontal plate extending horizontally outwardly from the end of the long vertical plate of the U-shaped projecting plate and being of a width slightly greater than the horizontal plate of the L-shaped projecting plate, and a short vertical plate extending longitudinally downwardly from the end of the horizontal plate of the U-shaped projecting plate and being of a width less than that of the long vertical plate.

Accordingly, the L-shaped projecting plate of the first plank can be held within and on the U-shaped projecting plate of the second plank. If necessary, the number of the planks may be increased to form an architectural plastic roof or partition wall.

BRIEF DESCRIPTION OF THE DRAWINGS

Other features and advantages of the present invention will become apparent from the following detailed description of a preferred embodiment of the present invention with reference to the accompanying drawings in which.

DETAILED DESCRIPTION OF THE PREFERRED EMBODIMENTS

Figure 1:
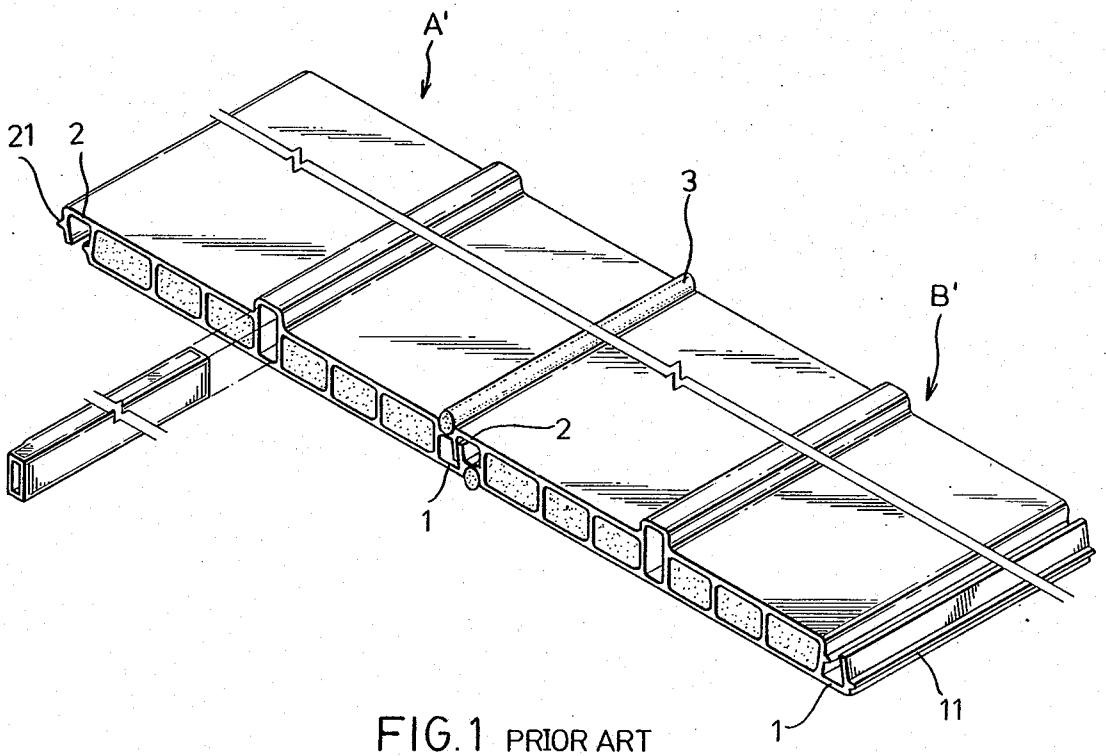
FIG. 1 PRIOR ART
FIG. 1 is a schematic view of a conventional assembly of two interconnected similar plastic planks.
Figure 7:
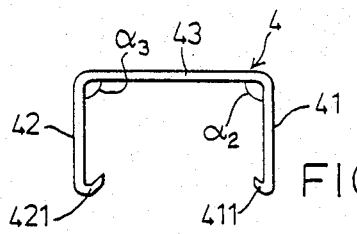
FIG. 7 is a sectional view showing the U-shaped cover according to the first embodiment of the present invention.
Figure 5:
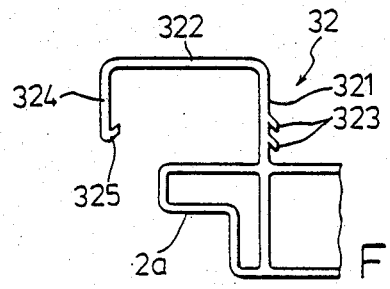
FIG. 5 is a schematic view showing the left side of the plank according to the first embodiment of the present invention.
Figure 4:
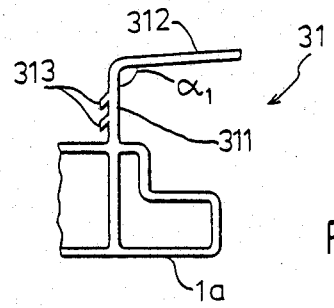
FIG. 4 is a schematic view showing the right side of the plank according to the first embodiment of the present invention.
Figure 2:
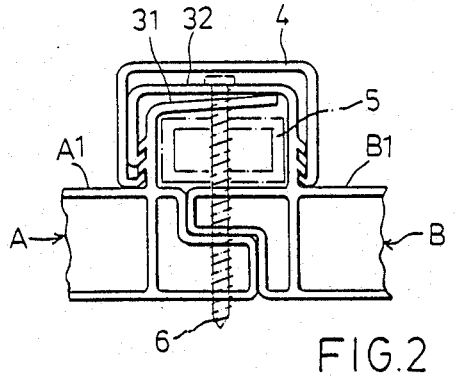
FIG. 2 is a schematic view showing an improved assembly of two interconnected similar plastic planks, a U-shaped cover, a rectangular tube, and a tap screw according to the first embodiment of the present invention, in which the tap screw and the rectangular tube are shown in the phantom lines, the U-shaped cover being sleeved on the planks by two transverse tongue and groove means.
Figure 6:
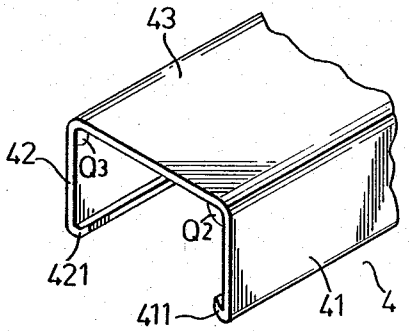
FIG. 6 is a perspective view showing part of the U-shaped cover according to the first embodiment of the present invention.
Figure 3:
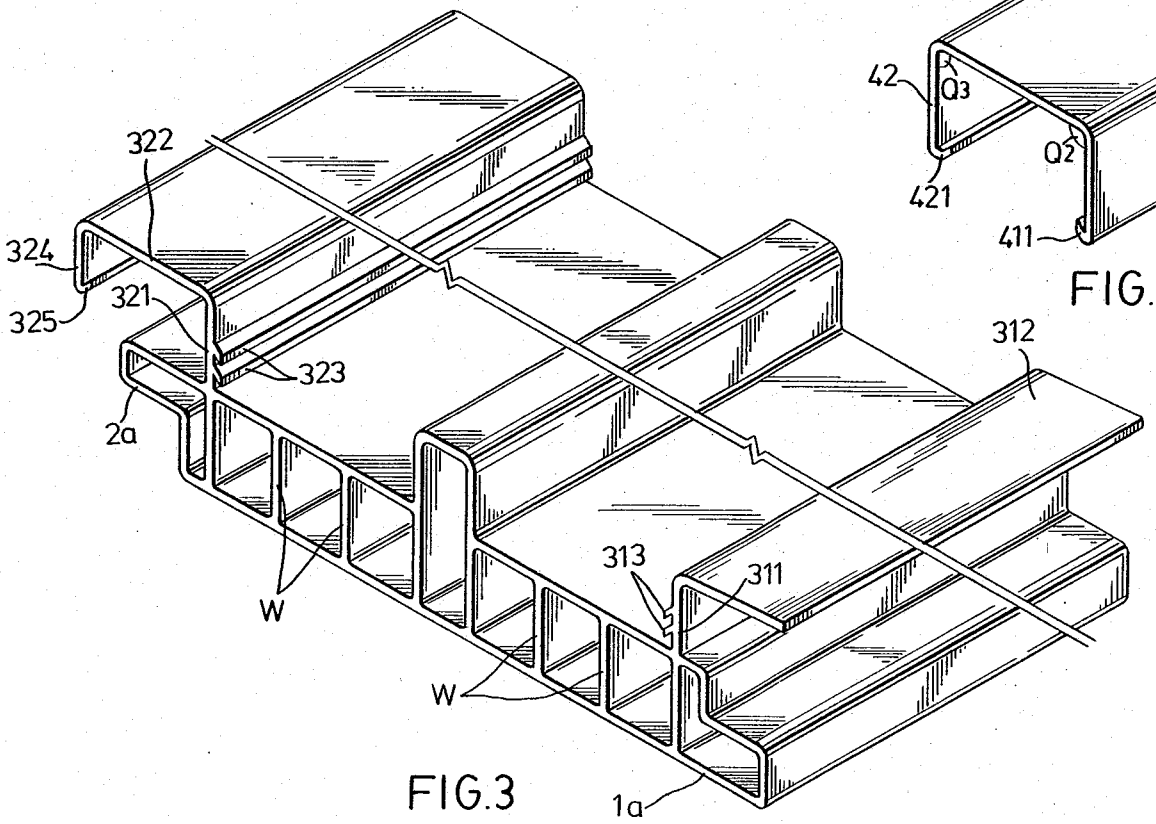
FIG. 3 is a perspective view showing one of the planks of the improved assembly according to the first embodiment of the present invention.

Referring to FIG. 2 with reference to FIGS. 3 to 7, an assembly according to the first embodiment of the present invention comprises two interconnected similar plastic planks A and B, a U-shaped cover 4, a rectangular tube 5, and a tap screw 6. Integrally formed on the right side of the plank A, B are a right L-shaped projecting plate 31 and an L-shaped abutment portion 1*a*. The planks A and B are hollow and reinforced by means of webs W (see FIG. 3) formed inside the planks A and B. Integrally formed on the left side of the plank A, B are a U-shaped projecting plate 32 and a left L-shaped abutment portion 2*a*. The right abutment portion 1*a* of the left plank A abuts against the left abutment portion 2*a* of the right plank B.

The L-shaped projecting plate 31 includes a vertical plate 311 and a horizontal plate 312. Projecting from the left surface of the vertical plate 311 are two inclined plates 313 forming a retaining slot therebetween. The U-shaped projecting plate 32 includes a long vertical plate 321 formed with two inclined plates 323 on the right surface thereof, a horizontal plate 322, and a short vertical plate 324 having a barb-like end 325. The U-shaped projecting plate 32 of the right plank B is sleeved on the L-shaped projecting plate 31 of the left plank A while permitting the barb-like end 325 of the right plank B to engage with the retaining slot provided between the inclined plates 313 of the left plank A. It is noted that the short vertical plate 324 of the U-shaped projecting plate 32 can provide a water-proof effect when the assembly is used as a roof.

Preferably, the vertical plate 311 and the horizontal plate 312 of the L-shaped projecting plate 31 form an angle a1 slightly greater than 90 degrees therebetween so that the free end of the L-shaped projecting plate 31 of the left plank A pushes the U-shaped projecting plate 32 of the right plank B upwardly.

The U-shaped cover 4 consists of two parallel vertical plates 41 and 42, and a web 43 interconnecting the vertical plates 41 and 42. Each of the parallel vertical plates 41 and 42 has a barb-like end 411, 421 respectively retained between the upper surface A1 and the inclined plates 313 of the left plank A and between the upper surface B1 and the inclined plates 323 of the right plank B when the U-shaped cover 4 is sleeved on the U-shaped projecting plate 32 of the right plank B and hence on the L-shaped projecting plate 31 of the left plank A. Each of the parallel vertical plates 41, 42 and the web 43 form an angle a1, a3 slightly less than 90 degrees so that the barb-like ends 411 and 421 of the U-shaped cover 4 press over each of the planks A and B.

Referring to FIG. 2, the L-shaped projecting plate 31 and the right abutment portion 1*a* of the left plank A, and the U-shaped projecting plate 32 and the left abutment portion 2*a* of the right plank B define a generally parallelepiped space for receiving tightly the rectangular tube 5 which is shown in the phantom lines. Below the planks A and B, not shown is a framework which has a tap hole. Through holes are provided in the portion of the L-shaped projecting plate 31, the U-shaped projecting plate 32, the right abutment portion 1*a*, and the left abutment portion 2*a* opposing the tap hole of the framework for the insertion of the tap screw 6 therethrough.

It is understood that of the U-shaped cover 4 can provide an additional water-proof effect to the assembly of the present invention when it is used as a roof. In addition, such an assembly is attractive.

Figure 8:
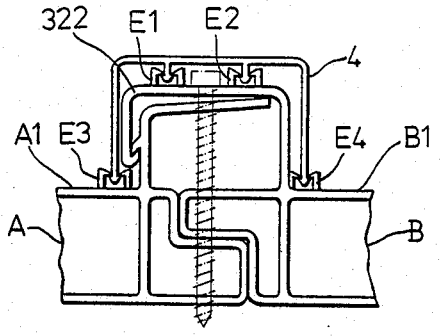
FIG. 8 is a schematic view showing an improved assembly of two interconnected similar plastic planks, a U-shaped cover, and a tap screw according to the second embodiment of the present invention, in which three longitudinal tongue and groove engagement means are provided between the U-shaped cover and each of the planks.

Alternatively, the U-shaped cover 4 may be positioned on the planks A and B by means of four longitudinal tongue and groove engagement means, as shown in FIG. 8. The first two engagement means E1 and E2 are provided between the horizontal plate 322 of the U-shaped projecting plate 32 and the cover 4. The third engagement means E3 is provided between the upper surface A1 of the left plank A and the cover 4. The fourth engagement means E4 is provided between the upper surface B1 of the right plank B and the cover 4. As illustrated, each of the longitudinal engagement means includes two adjacent retaining plates projecting upwardly from the plank A, B to form a retaining slot therebetween, and an insertion plate projecting downwardly from the cover 4 and inserted into the retaining slot formed by the two adjacent retaining plates. Each of the retaining plates and the insertion plates has an enlarged end so that the enlarged end of the insertion plates is retained entirely between the two adjacent retaining plates.

Figure 9:
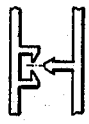
FIG. 9 is a schematic view-showing a first form of transverse tongue and groove engagement means which is used between the U-shaped cover and each of the planks according to the third embodiment of the present invention.
Figure 10:
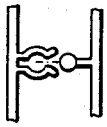
FIG. 10 is a schematic view showing a second form of transverse tongue and groove engagement means which is used between the U-shaped cover and each of the plank according to the fourth embodiment of the present invention.
Figure 11:
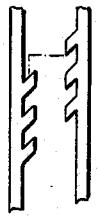
FIG. 11 is a schematic view showing a third form of transverse tongue and groove engagement means which is used between the fifth embodiment of the present invention.

As the modifications to the longitudinal engagement means between the cover 4 and the upper surface A1, B1 of the planks A, B, the transverse engagement means as shown in FIGS. 9 to 11 may be provided between the cover 4 and the vertical plate 311 of the L-shaped projecting plate 31 or between the cover 4 and the long vertical plate 321 of the U-shaped projecting plate 32. The engagement means of FIG. 9 includes two straight retaining plates each having a triangular enlarged end, and a straight insertion plate having a triangular enlarged end. The engagement means of FIG. 10 includes two S-shaped retaining plates and an straight insertion plate having an rounded end. The engagement means of FIG. 11 includes two pairs of three inclined parallel retaining plates.

Figure 12:
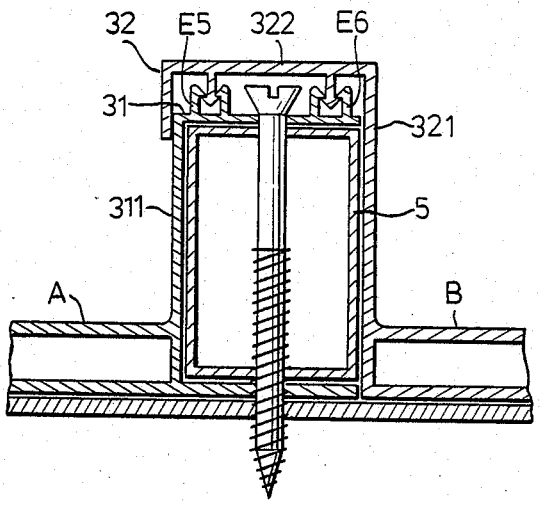
FIG. 12 is a schematic sectional view showing an improved assembly of two interconnected similar plastic planks, a rectangular tube, a tap screw, and a framework according to the sixth embodiment of the present invention.

Referring to FIG. 12, there is shown an improved assembly according to the sixth embodiment of the present invention. Unlike the embodiments of FIGS. 2 and 8, two longitudinal tongue and groove engagement means E5 and E6 are provided between the horizontal plate 312 of the L-shaped projecting plate 31 and the horizontal plate 322 of the U-shaped projecting plate 32. The longitudinal tongue and groove engagement means E5 and E6 are similar to that shown in FIG. 8 in construction.

Figure 13:
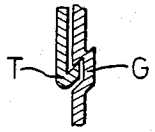
FIG. 13 is a schematic view showing an tongue and groove engagement means provided between the rectangular tube and the plank according to the seventh embodiment of the present invention.

To position the rectangular tube 5 between the planks A and B, the horizontal engagement means shown in FIG. 13, which includes a barb-like plate T and an inclined slot G, is preferably provided between the rectangular tube 5 and either the long vertical plate 311 of the L-shaped projecting plate 31 or the vertical plate 321 of the U-shaped projecting plate 32.

Figure 14:
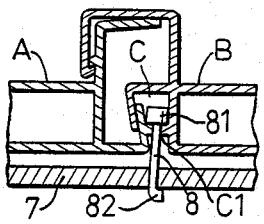
FIG. 14 is a schematic sectional view of an improved assembly of two interconnected similar plastic planks, a rafter, and a T-shaped hook according to the eighth embodiment of the present invention.
Figure 15:
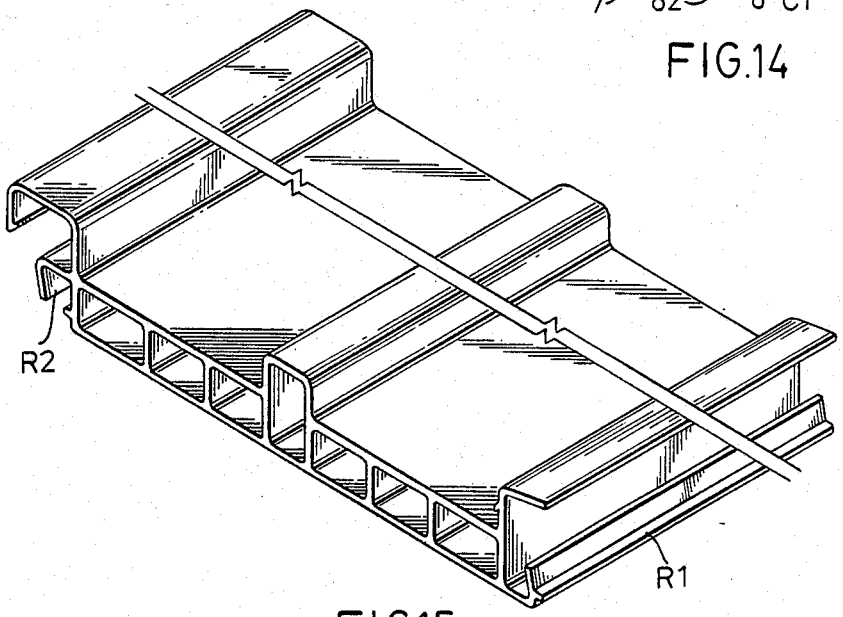
FIG. 15 is a perspective view of the plank according to the eighth embodiment of the present invention.

Referring to FIG. 14 with reference to FIG. 15, there is shown an assembly of two interconnected similar plastic planks A and B, a supporting rod 7 of a framework, and a T-shaped hook 8. Unlike the embodiment of FIG. 2, each of the planks A and B includes an irregular shaped right abutment portion R1 and an irregular shaped left abutment portion R2. When the planks A and B are interconnected, the interconnected left and right abutment portions R1, R2 form an accommodating chamber C which has an elongated rectangular opening C1 at the lower end thereof. The T-shaped hook 8 includes a horizontally extending rectangular head 81 of a width slightly less than that of the rectangular opening C1 of the chamber C, and a longitudinally extending curved portion 82. The length of the head 81 of the T-shaped hook 8 is greater than the width of the rectangular opening C.

In assembly, the head 81 of the T-shaped hook 8 is inserted into the chamber C through the rectangular opening C. Then, the head 81 of the T-shaped hook 8 is rotated through 90 degrees on a horizontal plane to a position as shown in FIG. 14 so that the T-shaped hook 8 is hung on the interconnected planks A and B. Finally, the curved portion 82 will hold the supporting rod 7 thereon.

As explained in the foregoing, the provision of the L-shaped projecting plate 31, the U-shaped projecting plate 32, and the U-shaped cover 4 permits the planks to be firmly connected with each other. Accordingly, the above-metioned objects of the present invention can be achieved.

The present invention thus explained, it is apparent that various modifications and variations can be made without departing from the scope and spirit of the present invention. It is therefore intended that the present invention be limited only as indicated in the appended claims.

What is claimed is:

1. An improved assembly of the type having two interconnected similar plastic planks, a framework, and a fastening means for attaching said planks to said framework, said planks including a first plank and a second plank, characterized in that each of said planks includes a first side including an L-shaped projecting plate thereon, a second side positioned opposite to said first side and including a U-shaped projecting plate, and means formed on said L-shaped projection plate and said U-shaped projection plate for holding said L-shaped projecting plate of said first plank on said U-shaped projecting plate of said second plank, each of said L-shaped projecting plates including a vertical plate extending longitudinally upwardly from the upper surface of said plank, and a horizontal plate extending horizontally outwardly from the end of said vertical plate, each of said U-shaped projecting plates including a long vertical plate extending longitudinally upwardly from the upper surface of said plank a distance slightly greater than that of said long vertical plate of said L-shaped projecting plate, a second horizontal plate extending horizontally outwardly from the end of said vertical plate of said U-shaped projecting plate and being of a width slightly greater than that of said horizontal plate of said L-shaped projecting plate, and a short vertical plate extending longitudinally downwardly from the end of said horizontal plate of said U-shaped projecting plate a distance less than said vertical plate of said U-shaped projecting plate; whereby, said L-shaped projecting plate of said first plank can be held within and on said U-shaped projecting plate of said second plank.

2. An improved assembly as claimed in claim 1, wherein said vertical plate and said horizontal plate of each of said L-shaped projecting plates form an angle slightly greater than 90 degrees therebetween.

3. An improved assembly as claimed in claim 1, wherein said holding means includes two tongue and groove engagement means each comprising:

two adjacent retaining plates projecting upwardly from the upper surface of said horizontal plate of said L-shaped projecting plate of said first plank to form a retaining slot therebetween, each of said retaining plates having an enlarged upper end; and an insertion plate projecting downwardly from the bottom surface of said horizontal plate of said U-shaped projecting plate and having an enlarged lower end entirely inserted into said retaining slot so as to be held by said retaining plates.

4. An improved assembly as claimed in claim 1, wherein said fastening means includes a supporting rod provided on said framework, an accommodating space formed between a lower portion of said first plank and a lower portion of said second plank, and a T-shaped hook including a horizontally extending head supported within said accommodating space, and a longitudinally extending curved portion holding said supporting rod of said framework thereon.

5. An improved assembly as claimed in claim 1, wherein said fastening means includes a tap hole formed in said framework, at least one through hole formed in either said first plank or said second plank and opposing said tap hole, and a tap screw passing through said through hole of said plank and said tap hole of said framework.

6. An improved assembly as claimed in claim 1, wherein said first and seconf planks form a parallelpiped space defined by said L-shaped projecting plate of said first plank, said U-shaped projecting plate of said second plank, a lower portion of said first plank, and a lower portion of said second plank.

7. An improved assembly as claimed in claim 6, further comprising a rectangular tube inserted tightly into said parallelepiped space so that said first plank connects firmly with said second plank.

8. An improved assembly as claimed in claim 7, wherein said rectangular tube is provided with a slot extending across the full length thereof, and wherein either said first plank or said second plank is provided with an insertion plate inserted into said slot so that said rectangular tube connects firmly with said first plank and with said second plank.

9. An improved assembly as claimed in claim 1, wherein holding means includes:

a first barb-like plate bent upwardly from an inward surface of said short vertical plate of said U-shaped projecting plate at a first angle; and at least one inclined plate, projecting downwardly from an outer surface of said vertical plate of said L-shaped projecting plate facing toward said second side of said plank at the first angle so that said at least one inclined plate of said L-shaped projecting plate of said first plank engages with said first barb-like plate of said U-shaped projecting plate of said second plank.

10. An improved assembly as claimed in claim 9, wherein said holding means includes a U-shaped cover and an attachment means for attaching said U-shaped cover to said L-shaped projecting plate and to said U-shaped projecting plate for interconnecting firmly said planks, said U-shaped cover having a pair of parallel vertical plates and a web interconnecting said parallel vertical plates, said web being of a width slightly less than that of said horizontal plate of said U-shaped projecting plate and either of said parallel vertical plates being of a height greater than that of said long vertical plate so that said U-shaped cover can be sleeved on said L-shaped and U-shaped projecting plates.

11. An improved assembly as claimed in claim 10, wherein each of said parallel vertical plates and said web form an angle slightly less than 90 degrees for sleeving tightly on said L-shaped and U-shaped projecting plates.

12. An improved assembly as claimed in claim 10, wherein said attachment means includes:

a second inclined plate projecting from the surface of said long vertical plate facing toward said first side of said plank at the first angle; and a second barb-like plate bent inwardly from the inner surface of each of said parallel vertical plates of said U-shaped cover at the first angle;

whereby, said second barb-like plates of said U-shaped cover can be respectively retained tightly between said first inclined plates and the upper surface of said first plank and between said second inclined plate and the upper surface of said second plank.

13. An improved assembly as claimed in claim 10, wherein said attachment means includes at least three tongue and groove engagement means which are provided between each of said planks and said U-shaped cover.

14. An improved assembly as claimed in claim 13, wherein each of said tongue and groove engagement means includes:

a pair of adjacent retaining plates projecting parallelly from one of said plank and said U-shaped cover to form a retaining slot between said retaining plates, each of said retaining plates having an enlarged end; and an insertion plate projecting from the other of said plank and said U-shaped cover and having an enlarged end entirely inserted into said retaining slot so as to be held by said retaining plates.

15. An improved assembly as claimed in claim 13, wherein said tongue and groove engagement means includes:

two adjacent first retaining plates projecting from one of said plank and said U-shaped cover at a predetermined angle to form a retaining slot; and two adjacent second retaining plates, projecting from the other of said plank and said U-shaped cover at said predetermined angle, one of said second retaining plates engaging with said retaining slot.

16. An improved assembly as claimed in claim 13, wherein at least one of said tongue and groove engagement means is provided between said horizontal plate of said U-shaped projecting plate of said second plank and said cover, second and third of said tongue and groove engagement means being provided between the upper surface of said first plank and said cover and between the upper surface of said second plank and said cover.

17. An improve assembly as claimed in claim 13, wherein one of said tongue and groove engagement means is provided between said horizontal plate of said U-shaped projecting plate of said second plank and said cover, a second one of said tongue and groove engagement means is provided between said vertical plate of said L-shaped projecting plate of said first plank and said cover, and wherein a third one of said tongue and groove engagement is provided between said long vertical plate of said second plank and said cover.

* * * * *